United States Patent [19]

Harms et al.

[11] Patent Number: 4,706,762

[45] Date of Patent: Nov. 17, 1987

[54] GRADE LEVELING DEVICE

[75] Inventors: John R. Harms; Ronald L. Anderson, both of Burlington, Iowa

[73] Assignee: J. I. Case Company, Racine, Wis.

[21] Appl. No.: 831,632

[22] Filed: Feb. 21, 1986

[51] Int. Cl.[4] ..... E02F 3/815; E01C 19/22

[52] U.S. Cl. ..... 172/684.5; 404/114; 414/722

[58] Field of Search ..... 37/117.5, 270, 271, 37/225; 172/832, 834, 253, 684.5, 764, 387, 665, 240, 393, 738, 241; 280/26, 19; 414/722, 694; 404/118, 83, 133, 114

[56] References Cited

U.S. PATENT DOCUMENTS

| | | | |
|---|---|---|---|
| 1,200,113 | 10/1916 | Hunter | 172/665 |
| 1,428,973 | 9/1922 | Northon | 172/387 |
| 2,357,849 | 9/1944 | Ray | 172/387 X |
| 3,217,431 | 11/1965 | Heinzroth | 172/832 |
| 3,427,937 | 2/1969 | Tope | 404/114 |
| 3,656,557 | 4/1972 | Eskelson | 172/387 |
| 3,909,149 | 9/1975 | Century | 404/133 |
| 4,230,435 | 10/1980 | Azevedo | 37/117.5 |
| 4,441,266 | 4/1984 | Westimayer | 37/271 |

FOREIGN PATENT DOCUMENTS

| | | | |
|---|---|---|---|
| 271554 | 6/1969 | Austria | 172/784 |

*Primary Examiner*—Richard J. Johnson
*Attorney, Agent, or Firm*—Peter N. Jansson, Ltd.

[57] ABSTRACT

A device for grade leveling having a lower member with a flat bottom surface terminating in an upwardly-beveled leading edge, upright members secured above the lower member, and first and second pivot-mounts on the uprights. One of said first and second pivot-mounts defines a fixed pivot axis on the uprights and the other defines a pivot location which is variable along an arc centered around said fixed pivot axis.

2 Claims, 5 Drawing Figures

GRADE LEVELING DEVICE

FIELD OF THE INVENTION

This invention is related generally to apparatus for grade leveling and, more particularly, to apparatus for leveling and smoothing areas exposed by the removal of concrete or other pavement in preparation for resurfacing.

BACKGROUND OF THE INVENTION

Grade leveling and smoothing are operations which are carried out for a variety of purposes, most notably in preparation for the application of a hard surface of concrete or other material. One specific requirement for a grade leveling and smoothing operation is the preparation of a surface for resurfacing. When an old concrete surface or other pavement surface is broken and removed, the sand or other newly-exposed grade is disturbed and must be leveled. In such a situation, major earth-moving operations are usually unnecessary.

Various device have been used for grade leveling and smoothing operations. These include hand-held tools, such as rakes and levelers, and a variety of wide blades which are supported on a vehicle which drives over the area to be leveled and smoothed. These devices are designed specifically for leveling and smoothing operations.

Other devices, intended for other purposes, are frequently adapted for simple grade leveling and smoothing operations. For example, devices such as backhoe buckets are dragged in a particular way over surfaces to be leveled. More specifically, the front surface of a backhoe bucket is drawn toward the backhoe vehicle and, during such movement, the orientation of the bucket is repeatedly adjusted to keep the front surface of the bucket approximately parallel to the ground. Such an operation requires a high level of skill to be successful, and even then does not produce a highly satisfactory result.

The disadvantages of manual leveling operations are apparent. Such operations are slow, and may be made even slower when coarse objects are encountered during the leveling operation. Likewise, the disadvantages of vehicle-mounted blades are apparent. Such devices are expensive, and certain jobs may not justify the use of very expensive equipment.

There is a need for a simple and inexpensive device for efficient and effective grade leveling and smoothing operations. In particular, there is a need for grade leveling and smoothing apparatus which can be used easily and effectively in preparing localized areas for resurfacing or repaving, after removal of an old surface.

SUMMARY OF THE INVENTION

This invention is an improved device for use in grade leveling and smoothing operations. The improved grade leveling and smoothing device of this invention overcomes some problems and deficiencies of the prior art, including those which are mentioned above.

The device of this invention is a rigid assembly which, in a preferred form of use, replaces the bucket of a backhoe. The grade leveling device of this invention will, for convenience, be described as mounted in the place of a backhoe bucket. The device of this invention, however, may also be used as a replacement member on a variety of other types of equipment, all of which are referred to herein as "tractors".

The device of this invention includes a lower member which has a flat bottom surface with an upwardly-beveled leading edge, upright means secured above the lower member, and first and second pivot-mounting means on the upright means, one of which defines a fixed pivot axis on the upright means and the other of which defines a pivot location which is variable along an arc centered around the fixed pivot axis.

The second pivot-mounting means is preferably a slot or pair of slots in the upright means, and such slot or slots are preferably arcuate, being centered around the fixed pivot axis defined by the first pivot-mounting means. In preferred embodiments, the fixed pivot-mounting means are closer than the variable pivot-mounting means to the leading edge of the lower member.

In one preferred form, a pair of spaced parallel ears, which extend upwardly from the lower member, form the the upright means. The first and second pivot-mounting means each include a pair of spaced mounts, and each of the ears has one mount of each pair of mounts. The ears are preferably a pair of parallel plates.

The first pivot-mounting means in such ears is a pair of aligned circular openings (or holes), one on each plate, which define the first pivot axis. The second pivot-mounting means in such ears is a pair of parallel arcuate slots, one on each of the ears. On each of the ears, the slot is centered about the circular opening. The circular openings are closer than the arcuate slots to the leading edge of the lower member.

It is required that the tractor on which the device of this invention is used have, as is common, a primary pivoting mount on a boom arm for attachment to the first pivot-mounting means, and a secondary pivoting mount on a tilt arm for attachment to the second pivot-mounting means. The second tilt arm is typically extendible with respect to the boom arm. When mounted in this fashion in place of a backhoe bucket, the leading edge of the lower member will be facing the vehicle and the vehicle operator.

The two circular openings receive opposite ends of a first mounting pin forming a primary pivoting mount at the end of the boom arm of a backhoe or similar device. Such mounting provides a fixed pivot point. The two arcuate slots receive opposite ends of a second mounting pin forming a secondary pivoting mount at the end of the tilt arm of the device. Since the pin may slide into any position in such slots, such mounting provides a variable pivot point.

Such mounting allows adjustment of the orientation of the grade leveling device of this invention without relative movement of the boom and tilt arms of the backhoe or similar device.

In operation on a backhoe, the grade leveling device of this invention is pulled toward the backhoe from an extended position, with the flat bottom surface of the lower member fully engaged with the ground. During such pulling motion, the grade leveling device of this invention remains flat on the grade without the constant repositioning that was necessary in using a backhoe bucket for grade leveling purposes.

During such pulling motion, the arcuate slots or other variable pivot location means allows the grade leveling device to maintain a horizontal orientation without relative adjustment or the primary and secondary pivoting mounts of the backhoe. When arcuate slots are used, the pins of the secondary pivoting mount move generally downwardly in the slot as the grade leveling device of this invention is pulled toward the backhoe operator. And, the slots allow the grade leveling device to "float" in upward and downward directions as it encounters localized disturbances in the grade, thus facilitating the leveling and smoothing operations.

The device of this invention does not require a dedicated vehicle or control apparatus for its operation and control. It may use the standard controls of a backhoe or other similar power machinery. The operation of this invention is simple and efficient, and proper use does not require a lengthy training period. The invention is particularly useful in preparing recently stripped surfaces for resurfacing.

OBJECTS OF THE INVENTION

It is an object of this invention to provide an improved device for grade leveling and smoothing which overcomes certain problems and deficiencies in the prior art.

Another object of this invention is to provide a simple but effective grade leveling and smoothing device not requiring dedicated power equipment.

Another object of this invention is to provide a simple and effective grade leveling and smoothing device which can be mounted on and manipulated by standard multi-purpose earth-moving equipment.

Another object of this invention is to provide improved grade leveling and smoothing equipment which is especially useful in preparing localized areas for resurfacing.

These and other objects will be apparent from the following additional descriptions and from the drawings wherein:

DETAILED DESCRIPTIONS OF PREFERRED EMBODIMENT

Figure 1:
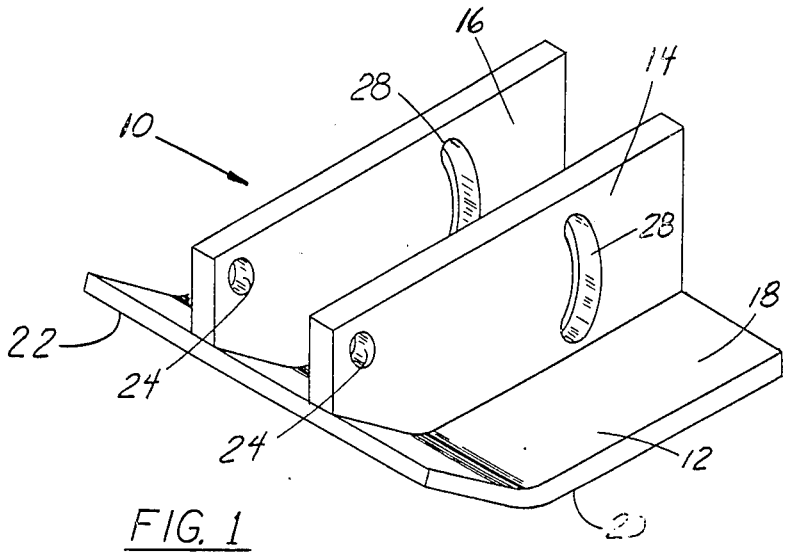
FIG. 1 is a perspective view of a preferred grade leveling device in accordance with this invention.

The figures illustrate a preferred grade leveling device 10 in accordance with this invention. Grade leveling device 10 includes a lower member 12 and a pair of upright parallel plates (or "ears") 14 and 16 which are welded to the upper surface 18 of lower member 12.

Lower member 12 is generally rectangular in shape and has a flat bottom 20 which is normally horizontal in its orientation. Lower member 12 has an upwardly beveled leading edge 22, which may be formed by bending lower member 12. Grade leveling device 10 is dragged along the ground with beveled leading edge 22 first. In this way, leveling device 10 readily receives, and thereafter applies downward force on, irregularities and small objects on the grade.

Lower member 12 and upright plates 14 and 16 are rigidly welded together, and their combined weight is enough to provide the necessary force for leveling and smoothing the grade. Other forms of attachment may be used, and different shapes and configurations may be used as well.

Upright plates 14 and 16 have aligned round pin-receiving holes 24. Holes 24 form a first pivot-mounting means for grade leveling device 10 and define a fixed pivot axis 26, illustrated in FIG. 2. Upright plates 14 and 16 also each have an arcuate slot 28. Arcuate slots 28 are parallel and aligned with one another, and each is centered with respect to the hole 24 in its upright plate. Arcuate slots 28 form a second pivot-mounting means and define a pivot location which is variable along the arc encompassed by arcuate slots 28.

Figure 2:
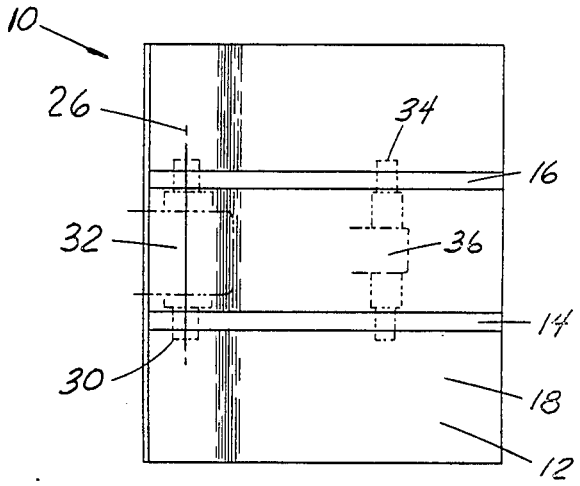
FIG. 2 is a top plan view, with certain portions of a backhoe illustrated in phantom lines.
Figure 3:
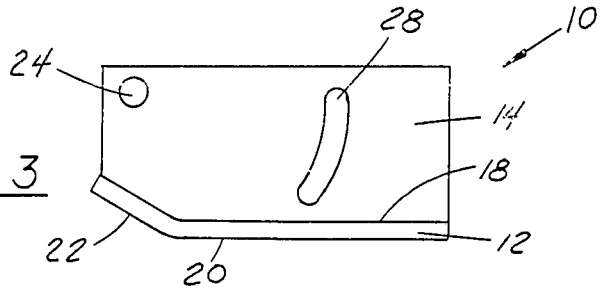
FIG. 3 is a side elevation.
Figure 4:
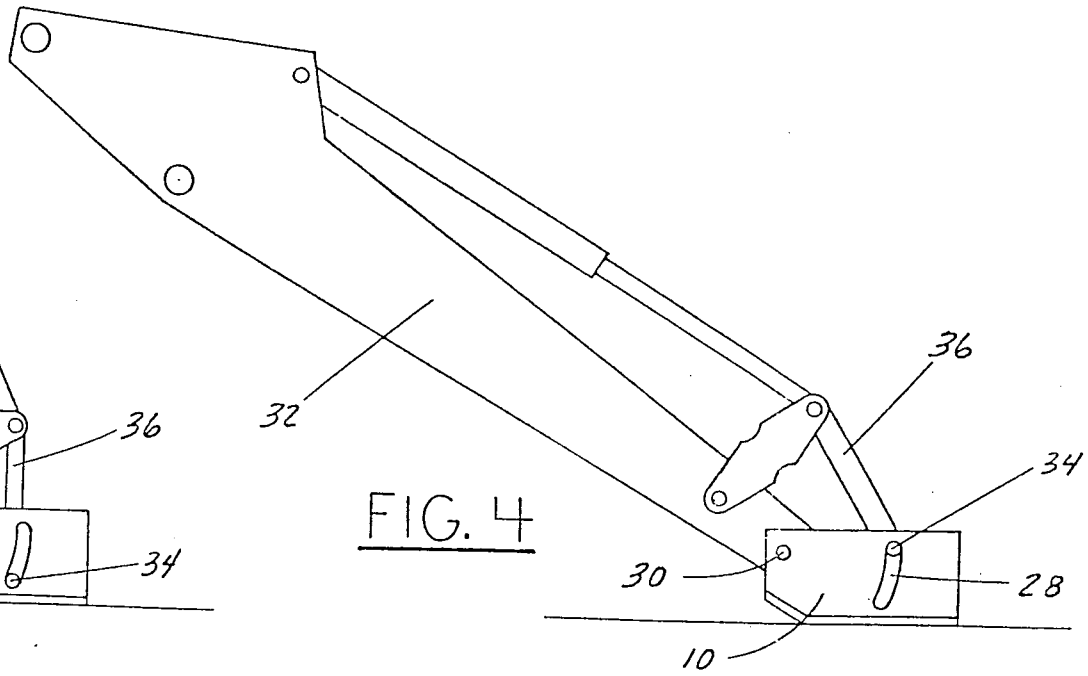
FIGS. 4 and 5 are fragmentary side elevations of a backhoe with the device of this invention mounted in place of the backhoe bucket, illustrating the device in extended and retracted positions, respectively.
Figure 5:
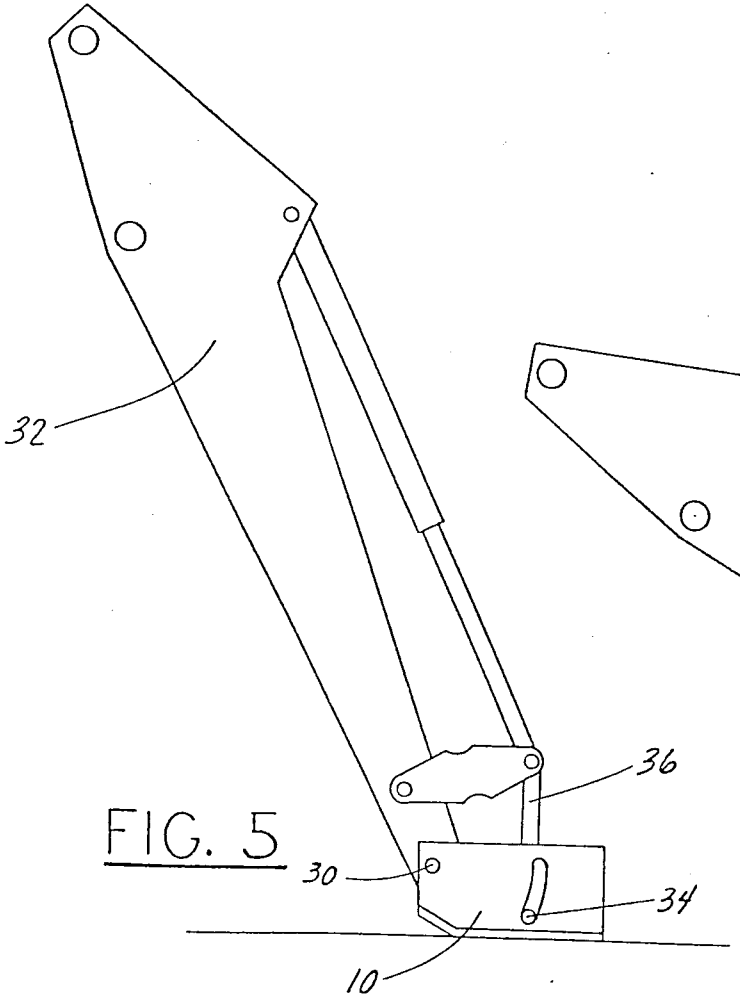

As illustrated in FIGS. 2, 4 and 5, holes 24 receive a mounting pin 30 which provides a primary pivot-mount at the end of the boom arm 32 of a backhoe. Likewise, a mounting pin 34, which is a pivot mount at the end of a tilt arm 36, extends between and through arcuate slots 28.

Holes 24 are located closer than arcuare slots 28 to beveled leading edge 22. First arm 32 of a backhoe pulls grade leveling device 10 along by means of the attachment of mounting pin 30 in holes 24. The orientation of grade leveling device 10 need not change as the position of mounting pin 34, relative to the position of mounting pin 30, varies while grade leveling 10 is dragged along the ground. Instead, grade leveling device 10 remains in a generally constant horizontal orientation and mounting pin 34 moves within arcuate slots 28.

FIGS. 4 and 5 illustrate this operation. FIG. 4 shows the device in an extended position, with mounting pin 34 at or near the top of arcuate slots 28. FIG. 5 shows grade leveling device 10 in a retracted position, with mounting pin 34 at or near the lower end of arcuate slots 28. Of course, adjustments of the relative position of mounting pin 34 with respect to the position of mounting pin 30 may be made for any reason, but maintaining the proper orientation of grade leveling device 10 does not require such adjustments.

As irregularities in the surface of the ground are encountered, grade leveling device 10 can adjust itself by moving up or down as required. Arcuate slots 28 accommodate such movement about pivot axis 26 which is defined by holes 24.

As previously noted, variations may be made in the form and construction of the grade leveling device of this invention. For example, it is not essential that the first and second pivot-mounting means be in upright plates. Holes and slots can be formed in lesser structures, and a variety of other pivot-mounting mechanisms are possible. The grade leveling device of this invention can be made in various sizes, depending upon the task to be accomplished. In some cases, the device is preferably the width of a sidewalk or other surface to be leveled and smoothed. In other cases, the device may be narrower than the surface to be treated.

While the principles of this invention have been described in connection with specific embodiments, it should be understood clearly that these descriptions are made only by way of example and are not intended to limit the scope of the invention.

What is claimed:

1. A tractor-operable apparatus for grade leveling comprising:

tractor boom and tilt arms extending to first and second tool-mounting ends, repectively, which have first and second horizontal mounting pins, respectively; and a ground-engaging device attached to both of said tool-mounting ends and including:

a lower member having an uninterrupted flat bottom surface with an upwardly-beveled leading edge beneath said arms, a pair of laterally spaced upright members rigidly affixed to and extending upwardly from the lower member, a pair of aligned circular apertures in the upright members, the first horizontal mounting pin extending therein for pivotable attachment of the boom arm to the upright members about a fixed axis, and the upright members including a pair of parallel arcuate slots centered about the fixed axis, the second horizontal mounting pin extending freely therein for slidable and pivotable attachment of the tilt arm to the upright members along the slots, whereby the ground-engaging device is free to float about the fist pivot axis to accommodate both changes in its position of extension from the tractor on the tractor arms and changes in the grade during movement over the grade toward the tractor without reorientation steps by the operator.

2. The device of claim 1 wherein the first pivot-mounting is closer than the second pivot-mounting means to the leading edge.

* * * * *